United States Patent [19]

Jürgens

[11] 4,452,322

[45] Jun. 5, 1984

[54] DRILLING DEVICE FOR DRILLING A CORE IN DEEP DRILL HOLES

[75] Inventor: Rainer Jürgens, Altencelle, Fed. Rep. of Germany

[73] Assignee: Christensen, Inc., Salt Lake City, Utah

[21] Appl. No.: 377,740

[22] Filed: May 13, 1982

Related U.S. Application Data

[63] Continuation of Ser. No. 137,174, Apr. 4, 1980, abandoned.

[30] Foreign Application Priority Data

May 11, 1979 [DE] Fed. Rep. of Germany ..... 2919007

[51] Int. Cl.[3] ..... E21B 4/02; E21B 25/00

[52] U.S. Cl. ..... 175/107; 17/237; 17/317

[58] Field of Search ..... 175/58, 107, 317, 236, 175/237, 232; 166/329

[56] References Cited

U.S. PATENT DOCUMENTS

| | | | |
|---|---|---|---|
| 2,910,273 | 10/1951 | Bor | 175/107 |
| 2,915,285 | 12/1959 | Deily | 175/107 |
| 2,944,792 | 7/1960 | Gros | 175/107 |
| 3,055,440 | 9/1962 | Tiraspolsky et al. | 175/107 |
| 3,850,194 | 11/1974 | Brown | 166/329 |
| 3,989,114 | 11/1976 | Tschirky | 175/317 |

*Primary Examiner*—William F. Pate, III

*Attorney, Agent, or Firm*—Rufus M. Franklin

[57] ABSTRACT

In a core drilling apparatus wherein a core bit is driven by a hydraulically actuated Moineau type motor, control valve means are provided whereby drilling fluid can be directed through the core sleeve to remove debris from its interior, and, subsequently diverted outside of the core sleeve when drilling begins. Alternative constructions are shown whereby the flushing of the core sleeve can be accomplished with the motor drive in an inactive mode or in an operating mode.

12 Claims, 9 Drawing Figures

DRILLING DEVICE FOR DRILLING A CORE IN DEEP DRILL HOLES

This application is a continuation of application Ser. No. 06/137,174, filed Apr. 4, 1980 abandoned.

FIELD OF THE INVENTION

The invention relates to a drilling device for drilling a core in deep drilled holes consisting of a direct drive (i.e. downhole motor) set up with the drill hole end of a pipe line connectable to the drill flushing fluid and of a core drill device which comprises a direct drive attached to the rotor, an outer sleeve supporting an auger tip and a core sleeve coaxially arranged in the latter which limits an annular space with the outer sleeve, the part of the axial flow path of the drill flushing fluid passage through the drill tool and its inner end facing to the direct drive is provided with a check valve opening with the occurrence of a pressure drop from the inner cavity of the core sleeve to the environment.

BACKGROUND OF THE INVENTION

With well known drilling devices of this kind, which find application in individual core processes, the check valve on the inner end of the core sleeve has the task to allow the exit from the latter the flushing liquid used in the drilling operation with continuous washing of the core in the core sleeve.

SUMMARY OF THE INVENTION

This invention has for its basis to create a core drill device of the stated type in which the possibility is given of a flushing of the core sleeve in order to remove from the latter, prior to the start of a core drilling process, drilling debris and similar components which have accumulated there with the introduction of the drilling device into the drill hole.

This problem is solved according to the invention first of all in such a way that the core sleeve is connected by way of an inlet channel with the flow path of the drill flushing fluid and permits flow of the drill flushing fluid in the direction to the drill hole bottom as well as including a stop valve cutting off the participation of this flow of the core sleeve. Through the passage opening created in this manner in the area over the core sleeve for drill flushing, the flushing liquid can now be introduced into the upper end of the core sleeve and in the lower open end be carried out in order to flush the core sleeve thoroughly prior to the start of a coring process.

The stop valve makes possible the interruption of the flushing of the core sleeve to a specific desired time. The flushing possibility of the core sleeve is fundamentally given in the scope of the invention when the direct drive is already running or also then when the latter is still not running.

In a further development of the invention the core sleeve has in the inlet channel for the drill flushing a valve seat surrounding a passage opening for the latter as part of the stop valve on which a separate, independent valve body of the stop valve is displaceable. It is especially appropriate, in the flow direction of the drill flushing fluid upstream of the core sleeve in the drilling device, to provide a releasable storage device for at least one such releasable valve body of the stop valve. A single valve body is sufficient if the stop valve is formed at the same time as a check valve for an exit of flushing liquid in continuous washing of the core, while two valve bodies are provided when two valves with separate functions are provided. Both possibilities are given within the scope of the invention.

Numerous further characteristics and advantages of the invention result from the claims and the following description in connection with the drawing in which several type model examples of the subject of the invention are schematically made clear.

DETAILED DESCRIPTION OF THE INVENTION

Figure 1:
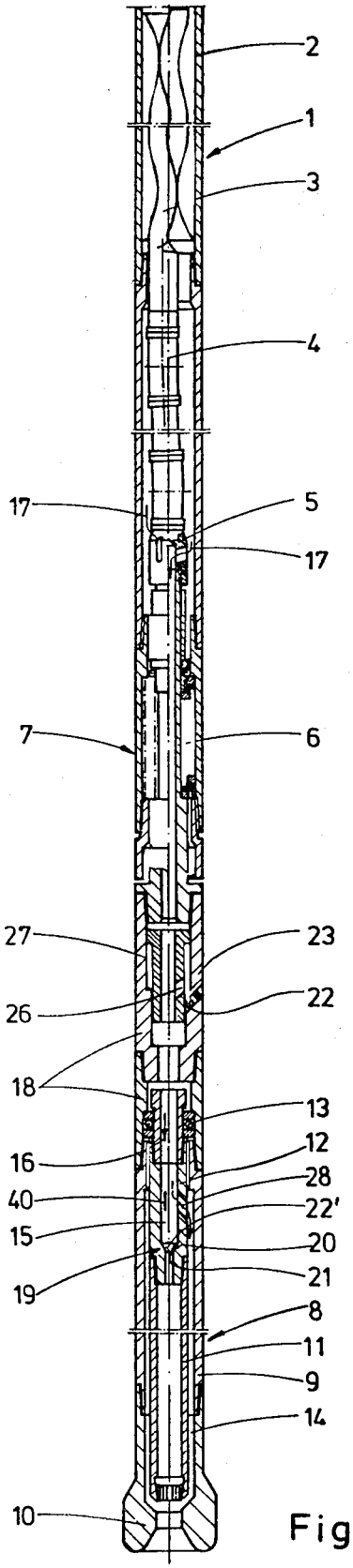
FIG. 1 an initial type model example of a core drilling device in a schematic longitudinal section, FIG. 2 a detail of the drilling device according to FIG. 1 in enlarged scale vis a vis the latter, and FIGS. 3 to 9 each a further type model example of a core drilling device according to the invention in a representation corresponding to FIG. 1.

As is evident first of all from FIG. 1 the core drilling device comprises a direct valve 1 according to a MOINEAU design having a stator 2 forming the outer body of the drive and a rotor 3 forming an inner body of the drive which by well known ways limit a working space between them. The stator 2 of the direct drive 1 is firmly connected with the stationary drill pipe line not further represented. By means of the latter flushing liquid as a work medium is pumped downwards and enters the work space under high pressure through which it undergoes a helical path; in so doing a part of the pressure energy of the work medium is transformed into rotational energy for the tool.

The rotor 3 is connected by way of a jointed shaft 4 and a reversing tube section 5 attached to the latter for the flushing liquid with a screwed on hollow shaft 6 to the bearing block 7 of the direct drive 1.

In addition, the drilling device comprises as a whole the core drill device designated by 8 which for its part consists of an outer sleeve 9 with a core drill tip 10 attached to the bottom end and an inner core sleeve 11. On its upper end the core sleeve is screwed onto a sleeve section 12 of a smaller diameter. By means of a bearing device 13 between the outer sleeve 9 and the sleeve section 12 the unit formed by the latter and the core sleeve 11 is held coaxially to the outer sleeve 9 of the core drill device 8. The sleeve unit 11,12 bounded by an annular space 14 with the outer sleeve 9, the part of the axial flow path of the drill flushing fluid is formed through the drilling device.

The sleeve section 12 is constructed open on the upper side and defines an inlet channel 15 for flushing liquid to the core sleeve 11. By this means the core sleeve 11 is capable of flow through by the flushing liquid in a direction to the drill hole bottom or to the drill tip 10 as is represented by an arrow 16 in FIG. 1.

Such a flushing of the core sleeve 11 takes place prior to a core drilling operation in which the direct drive 1 in the example according to FIG. 1 is running and the flushing liquid exiting from the work space formed between the stator 2 and rotor 3 through the reversing tube section 5 corresponding with the arrows 17 enters into the hollow shaft 6; this as well flows through subsequently a connecting sleeve section 18 and at 16 into the inlet channel 15 in order to flush out the core sleeve 11.

The flushing of the core sleeve 11 can be interrupted in its entirety by means of a stop valve designated by 19 which comprises a valve seat 20 which surrounds a flow through opening 21 in the inlet channel 15 for the drill flushing. On this valve seat 20 is a separate, independent valve body 22 for example in the shape of a ball which is displaceable.

The valve body 22 can be restrained for example during the flushing of the core sleeve 11 in the inlet channel 15 and there be arrested against a downward directed interrupted motion for example by means of a latch. By means of a compressive or tensional force or, by a discharge torque moment, the arrestation for the valve body 22 can be raised and the latter released for the displacement motion on its valve seat 20.

An especially advantageous, in no way limiting construction however, is provided to the process of flushing so that the valve body 22 of the stop valve 19 for flushing of the core sleeve 11 is held outside of the inlet channel 15 for the flushing liquid and then is thrown into the inlet channel 15 when the flushing of the core sleeve 11 is to be interrupted.

Figure 2:
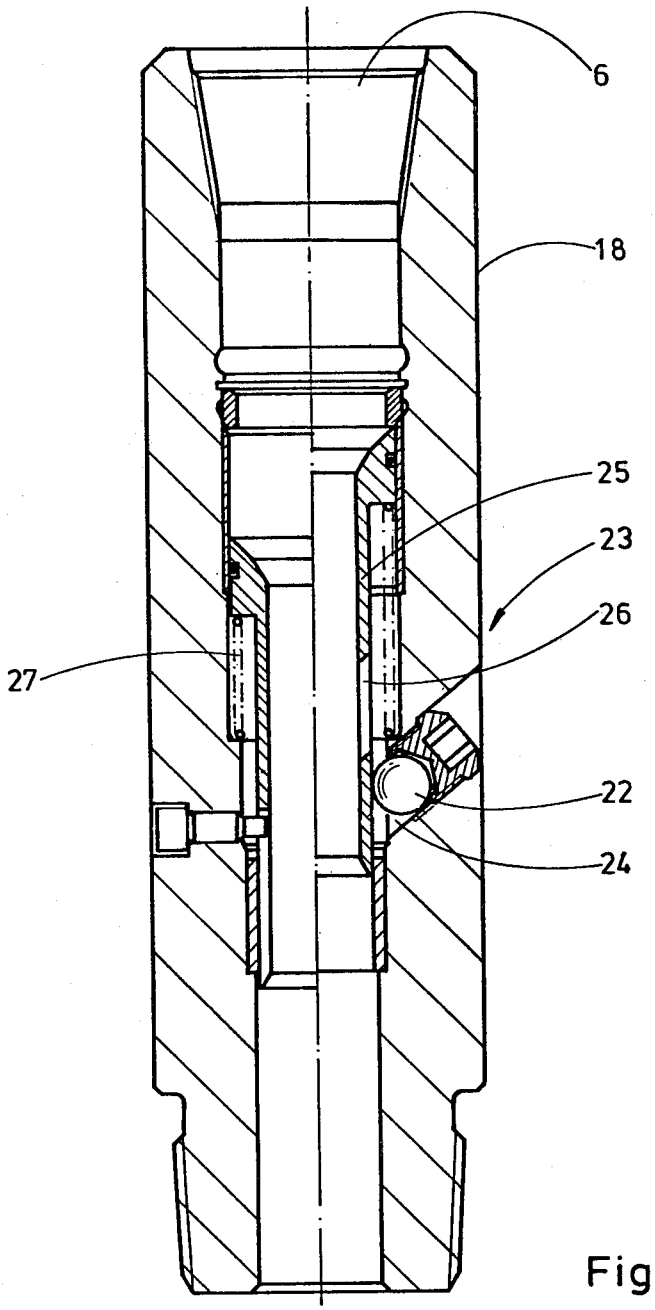

This is achieved in the type example according to FIG. 1 by means of a storage device 23 placed in the connecting sleeve section 18 upstream of the core sleeve 11 or its inlet channel 15 for the valve body 22. The storage device 23 which is represented in enlarged scale in FIG. 2 comprises an outer housing constructed with an opening 24 for the removal of the valve body 22 from the connecting sleeve section 18 and an annular body 25 arranged on the inside of the connecting sleeve section 18. The annular body 25 is axially displaceable in the connecting sleeve section 18 and has a peripheral opening 26 for a passage of the valve body 22 with an axial displacement of the annular body 25. According to the example illustrated the annular body 25 is under the preloading of a helical spring 27 and is formed as a piston housing which, when a certain flushing pressure is applied, performs a downward motion against the spring effect so that the valve ball 22 passes through the peripheral opening 26 and through the inlet channel 15 and can reach the valve seat 20 as is illustrated in 22' by dot-dash lines in FIG. 1. In FIG. 2 in the right half the closed position of the annular body 25 is illustrated in which the valve body 2 is kept back in the storage device 23 and in the left half of which is shown displaced in the downward position which has led to the passage of the valve body 22 through the opening 26.

If the valve body 22 is in the 22' position on its valve seat 20, then the process of flushing of the core sleeve 11 is interrupted. The flushing liquid then proceeds on its way through the annular space 14 to the drill tip 10 as is illustrated by means of a dashed line designated by the arrow 28. The drilling device is now driven for the drilling of a core. In so doing the outer sleeve 9 supporting the drill tip 10 rotates on the basis of its connection to the rotar 3 of the direct drive 1 while the core sleeve 11 by way of its engagement around the core, is stopped. The stop valve 19 at the same time acts as the non-return valve for the removal of flushing liquid out of the extension sleeve 12 of the core sleeve 11 with continous washing of the core in the core sleeve 11.

The attachment of the storage device between the direct drive 1 and the core sleeve 11 guarantees that the stop valve 19 is already present on the spot and ready to function which offers the fundamental advantage that existing direct drives and existing core drilling devices can be inserted. With such a design as is illustrated in FIG. 1 the passage opening for flushing fluid is beneath the end of the direct drive and leads, as is shown by means of the arrows 17, into the center of the customarily hollow bearing block shaft 6 which is in flow connection with the core sleeve 11.

The valve seat 19 can be arranged in any position in the range between the stated passage opening for the flushing liquid and the upper end of the valve seat as well as additional passage openings 40 are found through which flushing medium again is then transferable into the outer annular space 14 between core sleeve 11 and outer sleeve 9 when the valve body 22 is occupied closing its valve seat 19. The valve set 19 is, as is shown, arranged in the upper region of the sleeve unit 11 12 and the passage openings 40 for the return of the flushing medium into the annular spaced 14 is directly over it in order to draw out the bearing device 13 etc. of the flushing in the core drill operation.

Figure 3:
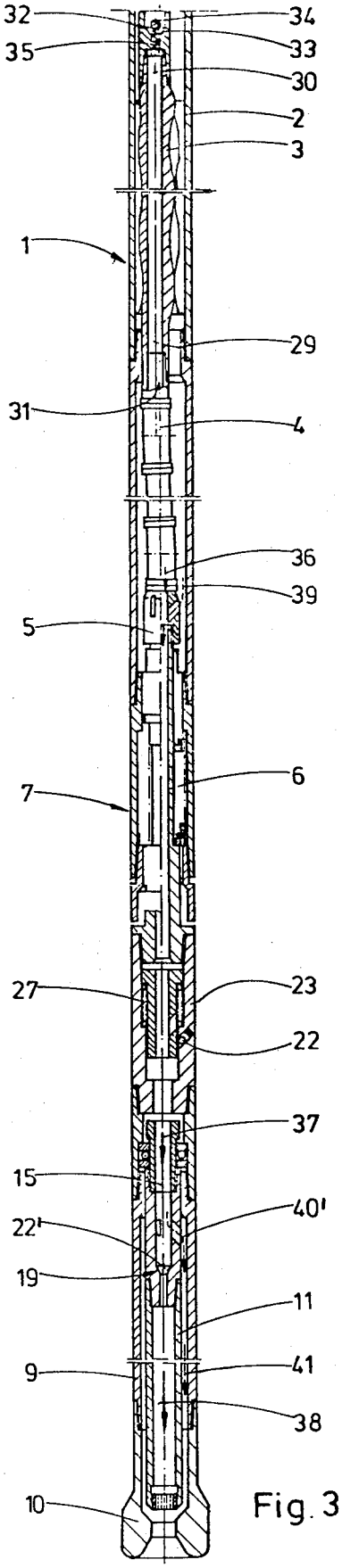

While in the type model example according to FIG. 1, the direct drive 11 is running during the flushing of the core sleeve 11, this is avoided in the type model example according to FIG. 3, which can be preferred for a facilitated entry of the drilling device into the drilling hole. The fundamental construction principle of the type model example according to FIG. 1 in regard to the direct drive 1 with the stator lying outside and with the inner or central rotor 3, is also retained in the type model example according to FIG. 3 so that for this as also for numerous additional coinciding construction parts the same reference symbols are used.

The species according to FIG. 3 is differentiated from that of FIG. 1 essentially in such a wy that the direct drive 1 has a central axial passage channel 29 for drill flushing which extends through the rotor 3 and whose entrance opening 30 is located upstream of the direct drive 1. The rotor 3 or its passage channel 29 is again by way of the jointed shaft 4 and the return sleeve section 5 for the flushing liquid connected with the bearing block shaft 6. In the present type model example the jointed shaft 4 is constructed as a hollow shaft with a central passage channel 31 in the extension of the passage channel 9 of the direct drive 1. In the region of the entrance opening 30 of the passage channel 29, an additional stop valve 32 is provided which closes the central passage channel 29 of the direct drive 1 or opens it when the flushing of the core sleeve 11 is to be ended. The second stop valve 32 has for its part a valve seat 33 leaving a passage opening for drill flushing fluid for a separate, independent valve body 34 displaceable on the latter in which again in the example illustrated is in the shape of a ball. The valve body 34 is supported by a spring 35 pressing from below for a flushing of the core sleeve 11. Up to a specific pressure in flushing, the stop valve is open and therewith the central flow of the direct drive 1 is given in the direction to the core sleeve 11. The core sleeve is correspondingly flowed through with the flushing fluid while the direct drive 1 is stationary, since the work spaces formed between the stator 2 and rotor 3, because of the open transmission channel 29, not flowed through to any significant extent by the flushing liquid as a work medium. If the flushing pressure increases over the predetermined value then the stop valve 32 closes by activation of the valve body 34 by overcoming the force of the spring 35 on the valve seat 33 so that the flushing liquid now flows through the work space of the direct drive 1 and the latter becomes active.

During the flushing of the core sleeve 11 the first stop valve 18 is of course also in the open position which also in this type model example works with the storage device 23 for the valve body 22. This releases in the manner already described with the help of the type model example according to FIG. 1 in reaching the prestated flushing pressure on the valve body 22 so that the latter arrives by means of the inlet channel 15 on its valve seat 20 as is illustrated by dashed lines 22' in FIG. 3. During the flushing of the core sleeve 11 with stop valves 32 and 19 opened, the flushing liquid therefore takes a flow path corresponding to the arrows 36 37 38 designated by solid lines while it takes, with stop valves 32 and 19 closed, a flow path corresponding to the dashed line designated arrows 39 40 and 41. The valve body 22 in its closed position 22' is admitted only by the reduced pressure of the flushing liquid through passage of the flushing liquid through the direct drive 1 so that since in the drill operation also within core sleeve 11 the pressure in general is equal to or less than this pressure, the stop valve 19 can operate without difficulty as a return valve.

Figure 4:
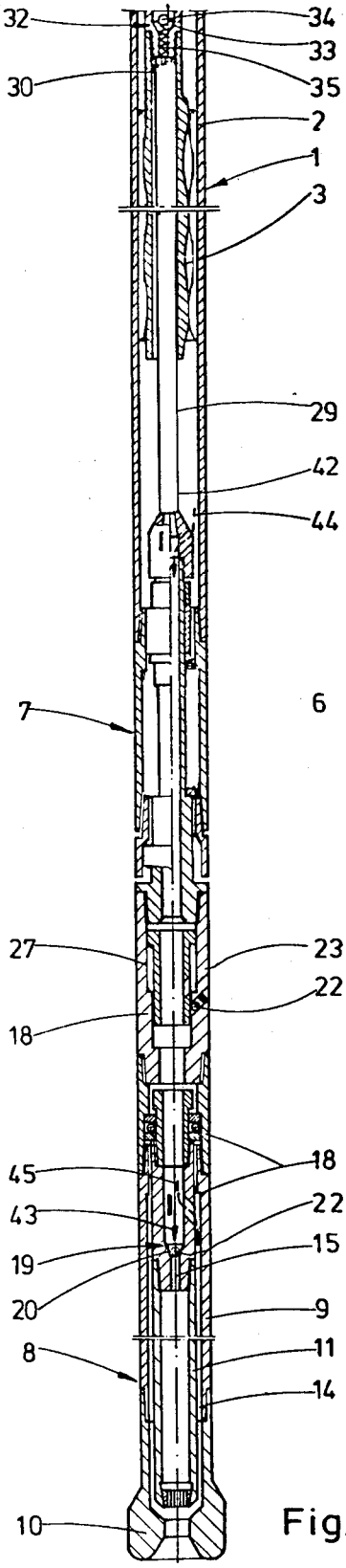

The type model example according to FIG. 4 is differentiated from that according to FIG. 3 essentially in such a way that the axial transmission channel 29 of the direct drive 1 is constructed as a so called bending tube or the like which is jointless, displacable, transmitting a torque moment connection and is joined to the hollow shaft 6 of the bearing block 7. The mode of action is, however, the same as in the case of the type model examples according to FIG. 3. During the flushing of the core sleeve 11 with flushing liquid with stop valves 32 and 19 open, the flushing liquid follows its flow path through the central transmission channel 29, the hollow shaft 6 of the bearing block 7, the connecting sleeve section 18 and the inlet channel 15 of the core sleeve 11 corresponding to the arrows 42 and 43 designated by solid lines. With stop valve 32 closed, the flushing liquid flowing out of the work space of the direct drive 1 enters through a return channel corresponding to the dash arrow designated by 44 in the hollow shaft 6 of the bearing block 7 flows through the connecting sleeve section 18 with storage device 23 which, in reaching the stated flushing pressure, releases the valve body 22 and lets it fall down on its valve seat 20 whereupon the flushing liquid enters through one or several connecting openings in the inlet channel corresponding to the arrow 45 designated by dashed lines out of the inlet channel 15 out and into the annular space 14.

Figure 5:
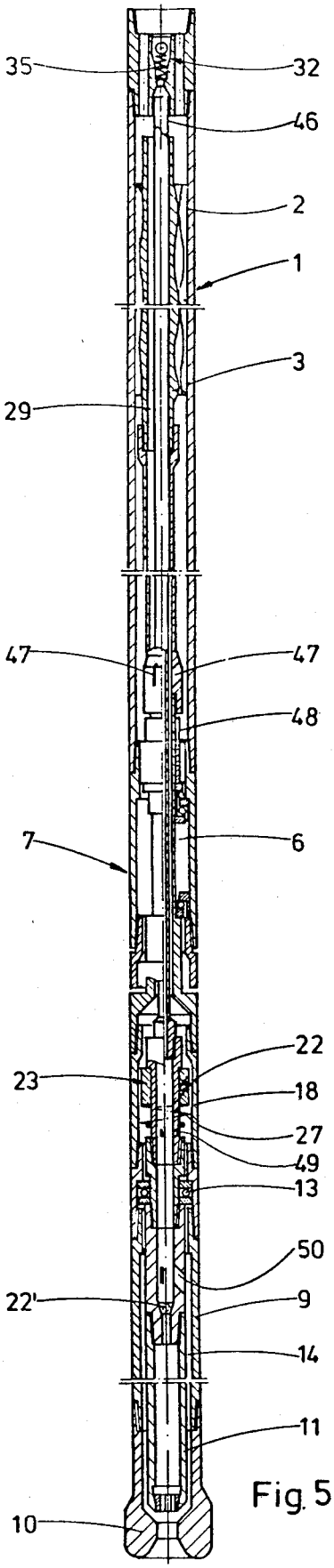

While in the type model examples according to FIGS. 1 to 4 an arresting of the core sleeve 11 in drilling a core takes place with the latter through friction; in the type model example according to FIG. 5 for avoidance of any core damages a positive locking of the core sleeve 11 against a torque motion is provided. The direct drive 1 with its outside stator 2 and inside rotor 3 has again the central transmission channel 29 through which however in the FIG. 5 species a tubular extension 46 of the core sleeve 11 extends through. The extension 46 is screwed on to the upper end of the core sleeve 11 and extends out from the latter through the connecting sleeve section 18 containing the storage device 23 as well as through the hollow shaft 6 of the bearing block 7 and is led up with its end region extending through the direct drive 1 up to the lower end of the stationary drill pipe line. Here an attachment not further illustrated is undertaken of the upper end of the extension 46 to the stationary drill pipe line so that the core sleeve 11 is secured positively against every torque movement. At the same time the extension 46 forms a conducting channel for a central transmission of drill flushing through the direct drive 1.

The remaining construction parts of the type model example according to FIG. 5 correspond to those according to the type model examples according to FIGS. 1 to 4 and have on this basis the same reference symbols.

Up to the specified pressure in the flushing the upper stop valve 32 is open through which the central flushing of the core sleeve 11 takes place by way of extension 46 of it. The direct drive 1 again remains stationary. If the flushing pressure increases, then the upper stop valve 32 closes with the result that the flushing now flows through the work space of the direct drive 1 so that the latter operates. Therefore the flushing occurring from out of the work space of the direct drive 1 is deflected through side openings 47 in an annular space between the core sleeve extension 46 and the hollow shaft 6. Beneath the hollow shaft 6 is, in the core sleeve extension 46, a passage opening 49 for the flushing liquid so that the latter first of all again can enter into the extension 46 and in this way is led through the core sleeve 11 while at the same time a further portion of the flushing liquid flows through the connecting sleeve section 18 downward and through the bearing device 13 and therefore the annular space 14 between the outer sleeve 9 and the core sleeve 11. If the valve body 22 is in its closed position 22', then the flushing liquid is again conducted into the extension 46 at 49 through a side opening 50 out of the extension 46 and then flows likewise through the annular space 14. In the species according to FIG. 6, a modified arrangement is provided of the direct drive 1 in a manner the central body of which is constructed as a stator 51 and the outside body of which as a rotor 52. The stator 51 is connected by way of an upper universal shaft 53 with the lower stationary end of the drill pipe line. The lower end of the stator 52 is connected by an additional universal shaft 54 with the core sleeve unit 11, 12 and indeed having the sleeve section 12 connected to the inlet channel 15 which is screwed on to the core sleeve 11. In this manner the core sleeve 11 is held positively locked stationary in the outer sleeve 9 of the core drill device 8.

The rotor 52 forming the outer body of the direct drive 1 in this species is connected directly to the outer sleeve 9 of the core drill device 8.

The stator 51 again has in the center of the direct drive 1 the central transmission channel 29 on whose upper end the second stop valve 32 is located corresponding to the model types according to FIGS. 3 to 5, while the first stop valve 19 is constructed in the manner already explained with the aid of the previous type model examples in the inlet channel of the core sleeve 11.

During the flushing of the core sleeve 11 with the upper stop valve 32 open, the direct drive 1' remains still and the flushing liquid moves exclusively through the central transmission channel 29 as well as through the universal shaft 54 constructed as a hollow shaft to the core sleeve 11 and flows through the latter. If the upper valve 32 closes at increased pressure in the flushing medium, then the flushing medium passes into the work space of the direct drive 1' and after that arrives in an annular space 55 continuing upward into the annular space 14 between the outer sleeve 9 of the core drill device 8 and the universal shaft 54. There are one or several passage openings 56 through which the flushing medium is fed frm the annular space 55 into the hollow extension 54' of the universal shaft 54. The storage device 23 for the valve body 22 is above the passage 56. The flushing liquid flows before its entrance into the passage openings 56 into the annular space between the housing of the storage device 23 and the outer sleeve 9. The pressure difference resulting from this leads in an over stepping of the nominal valve to the downward motion to the storage device 23 whereby the valve body 22 is released and the stop valve 19 closes.

In the closing of the second stop valve 19, the flushing liquid 19 enters through the openings 56 and the sleeve section 12 and out through one or several side openings 58 above the stop valve 19 corresponding to the dashed line designated by the arrow 59 and arrives in the annular space 14 and therewith to the drill tip 10.

Figure 6:
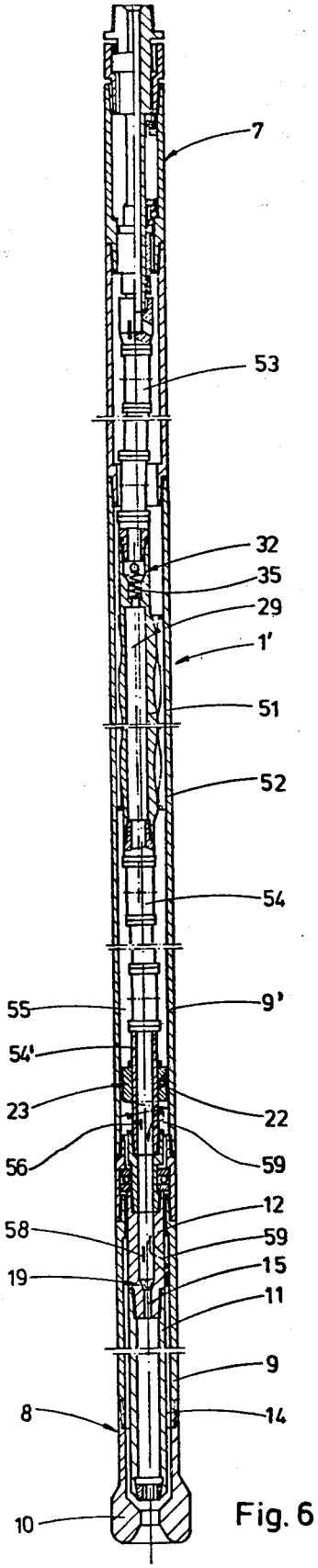
Figure 7:
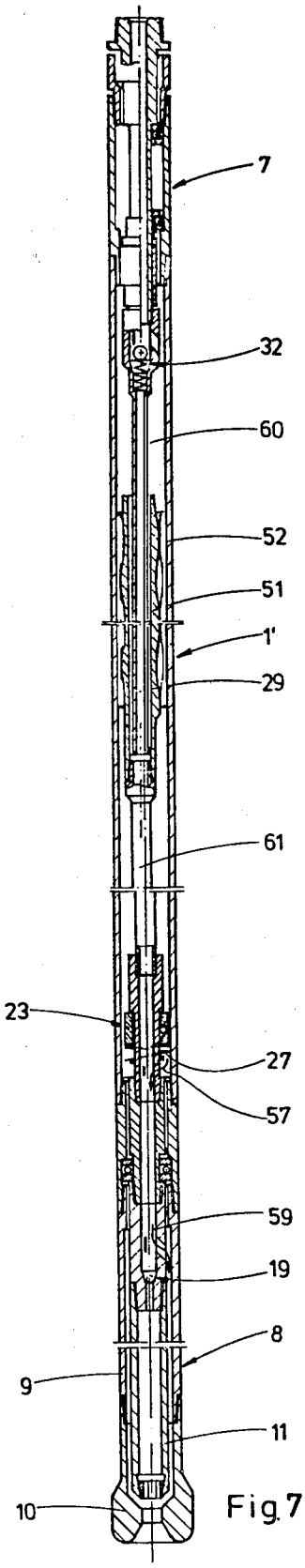

In the species according to FIG. 7 in place of the universal shafts 53 and 54 illustrated in FIG. 6, bending tubes 60 and 61 are provided for the connection to the central stator 51. In regard to the remaining construction parts the type model according to FIG. 6 is principally the same and corresponds also to it in the function particularly which concerns the positive arrangement of the core sleeve 11 and the guiding of the flushing liquid in the opened and closed stop valves 19 and 32.

Figure 8:
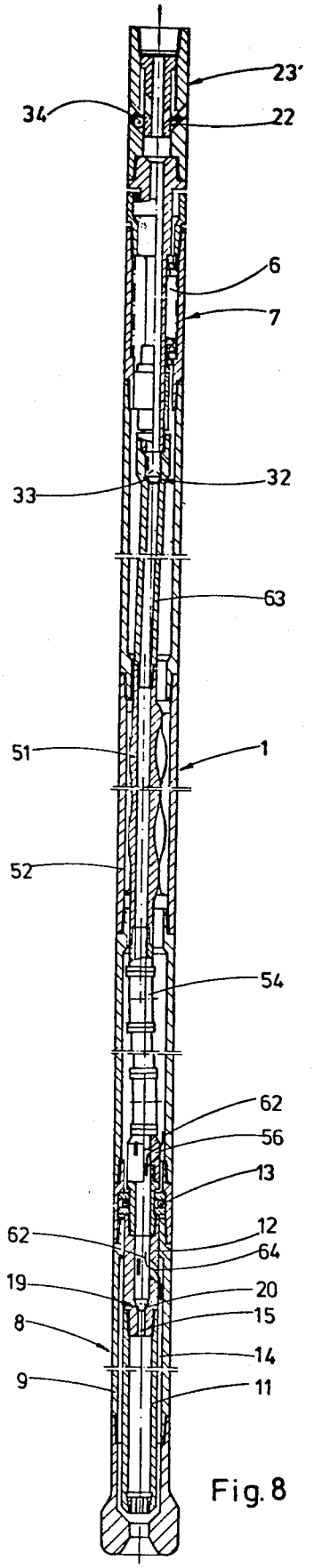

FIG. 8 shows a type model example analogous to the type model according to FIG. 6 or FIG. 7. In the universal shaft 54 between the central stator 51 and the upper end of the core sleeve 11 or the sleeve section 12 having the inlet channel 15, are one or several passage openings 64 for the flushing medium and under it the first, lower stop valve 19 with the valve seat 20. The connection between the stator 51 and the hollow shaft 6 of the bearing block 7 designates a bending tube shaft 63 joined to the stator on the upper end, which also can be joined with the lower end of the stator according to FIG. 7. However, this connection can also consist of a universal shaft with a central hole. Above the stator 51 is the second stop valve 32 with its valve seat 33 which is constructed in the upper end region of the bending tube shaft 63.

Upstream of the stop valve 32 is a displaceable storage device 23 for the two valve bodies 22 and 34. The two valve bodies 22 and 34 have, in so doing, different diameters, in which the first, smaller valve body 22 is provided for the lower stop valve 19 and the second, larger valve body 34 for the upper stop valve 32 can be used analogous to the illustration according to FIG. 2 for example with other diametrically opposite recesses 24 for the valve bodies 22 or 34 in each case in which this duplicate design operates in a manner so that first of all the smaller valve body 22 by passes the valve seat 33 of the upper stop valve 32 and seats on the valve seat 20 of the lower stop valve, in so doing, the flushing of the core sleeve 11 is shut off.

In spite of this shut off the flushing liquid by passes a before the direct drive 1 through the bending tube shaft 63 forming the central transmission channel without in so doing an activity of the direct drive 1' taking place. If now the larger valve body 34 from the storage device 23' is released, then the central channel through the bending tube shaft 63 is completely shut off and the flushing liquid now flows into the work space of the direct drive 1' formed between the stator 51 and the rotor 52. After the flushing liquid has passed through the work space of the direct drive 1' it arrives by way of the flow through of the channels 56 and 64 into the annular space 14 between the outer sleeve 9 and the core sleeve 11 of the core drilling device 8 as the arrows 62 show while next only with the displaced, smaller valve body 22 on the valve seat 20 does the flushing liquid arrive through the hollow universal shaft 54 to the passage openings 64 in the annular space 14 by way of flowing around the bearing device 13. With valves 19 and 32 opened, the central flushing analogous to the species according to FIGS. 3 to 7 takes place.

For the species collectively, the species according to FIG. 1 excepted, in which no central transmission through the direct drive is provided, there is a possible modification in a manner such that the lower stop valve 19 and/or the upper stop valve 32 first of all are designed only as a simple valve seat. The valve body in each case can in these cases be formed by a well known insertion body which is inserted above ground in the flushing. The insertion body is then carried downward by the flushing, passes the direct drive and is seated on the lower or upper valve seat.

Since in a direct drive with a central transmission channel two stop valves must be present, as otherwise the work space of the direct drive for actuation of the core drill device 8 cannot be flowed through by the flushing liquid as the lower valve under the complete flushing pressure existing over the direct drive would be present, such a one can be withdrawn as a valve body the lower stop valve 19 from a storage device like the storage device 23 while the insert body inserted above ground in the flushing seats itself on the valve seat of the upper stop valve 32.

If the lower seat is exceeded in diameter by the valve seat for the upper valve, the possibility exists in addition to close off both stop valves by means of an insert body in which then the first insert body has to be the one for the lower stop valve with a smaller cross section. Such a design is structurally extraordinarily simple and functionally safe in so far that it is guaranteed that the service personnel adhere to a certain sequence series of the insert bodies. During this process there is a time delay between the insertion of the first and second insert body required in order to guarantee a specific sequence series and sure seating. This is achievable with the previously described type model in a mechanical way without influence by the service personnel.

Figure 9:
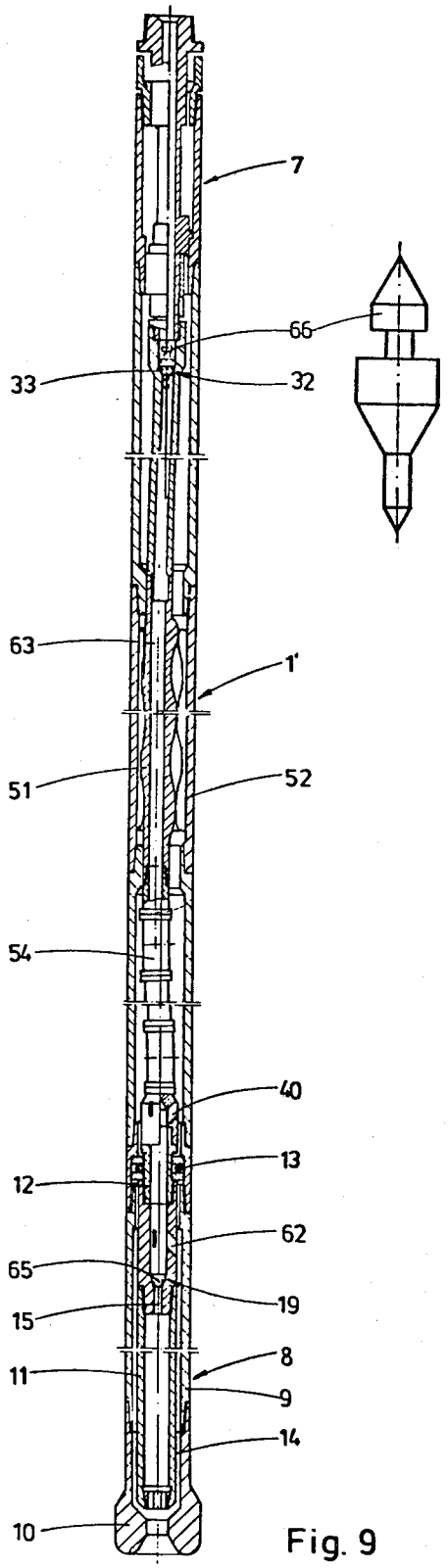

In FIG. 9 a species corresponding to FIG. 8 is represented for illustrative purposes in which for the lower stop valve 19 an insert body 65 is provided in the shape of a ball valve and for the upper valve seat 32 an insert body 66 with an inserted cone as is illustrated in enlarged detail in FIG. 9. Moreover the type model according to FIG. 9 corresponds in its construction and in its mode of action to the type model according to FIG. 8.

The core drill devices illustrated in FIGS. 6 to 9 are uniformly illustrated with bearing devices 13 for the core sleeve 11 which, however, do not necessarily have to include axial bearing components through which in addition to an architectural simplification also a simpler flushing passage from the annular space 55 (FIG. 6) is achieved in the annular space 14.

I claim:

1. A drilling device for drilling a core in deep well drilling holes consisting of an end connectable with the drill hole end of a pipe line, a downhole motor operated by the drill flushing fluid and a core drill which comprises a drill bit attached to the rotor of the downhole motor supported by an outer sleeve and an inner core sleeve arranged coaxially with said outer sleeve, which sleeves define an annular space; an axial flow path for the drill flushing fluid being formed through the drilling tool from the inlet of the downhole motor and being provided with a check valve opening from the inner space of the core sleeve to the environment, characterized in such a way that the core sleeve is connected by way of an inlet channel with the flow path of the drill flushing fluid and a flow path is provided in the direction for flushing to the drill hole bottom and including a stop valve for selectively stopping the flushing of the core sleeve.

2. A drilling device as in claim 1 in which said stop valve is kept outside of said flow path for discharge into said flow path, onto a valve seat, after the ending of the flushing, and an increase of fluid pressure above a preselected valve.

3. A drilling device according to claim 2 characterized in such a way that in the flow direction upstream of the core sleeve, a releasable storage device is provided for at least one releasable valve body of said stop valve.

4. A drilling device according to claim 3 characterized in such a way that the storage device is arranged between the direct drive and the core sleeve in the drilling device.

5. A drilling device according to claim 3 characterized in such a way that the storage device has an outer housing with a take off for the admittance of the valve body and an inner annular body surrounding a connecting channel for the hole flushing fluid and for a passage of the valve body for a removal from the annular body.

6. A drilling device according to claim 5 characterized in such a way that the annular body is under a preload and is formed as a piston housing which is movable downwards against the preload with an excess of a specific flushing pressure.

7. A drilling device according to claim 2 characterized in such a way that the downhole motor has a central, axial transmission channel for drill flushing fluid having an entrance opening located on the upstream side of the downhole motor.

8. A drilling device according to claim 7 characterized in such a way that said central transmission channel through the downhole motor is capable of being shut off by means of a second stop valve.

9. A drilling device according to claim 8 wherein said second stop valve has a valve seat enclosing a transmission opening for drill flushing fluid for a displaceable, separate valve body on the latter.

10. A drilling device according to claim 7 wherein the valve body of said second stop valve is biased in an open position by a spring acting upwardly on it for permitting flow during flushing of the core sleeve.

11. A drilling device according to claim 1 characterized in such a way that the rotor of the direct drive from which the outer body is formed on its upper end is connected to the lower, stationary end of the drill sleeve line and the inner body forming the stator of the direct drive at its lower end is connected with the upper end of the core sleeve.

12. A drilling device according to claim 8 wherein upstream of the entrance opening of said axial transmission channel of the downhole motor a releasable storage device for two valve bodies is provided, the two valve bodies have different diameters and the first, smaller, valve body being adapted to coact with the lower stop valve and the second, larger, valve body being provided to coact with the upper stop valve.

* * * * *